US009392864B2

(12) United States Patent
Reed

(10) Patent No.: US 9,392,864 B2
(45) Date of Patent: Jul. 19, 2016

(54) ACCESSORY FASTENING DEVICE

(71) Applicant: Chums, Inc., Salt Lake City, UT (US)

(72) Inventor: Scott McMurrin Reed, Park City, UT (US)

(73) Assignee: Chums, Inc., Salt Lake City, UT (US)

( * ) Notice: Subject to any disclaimer, the term of this patent is extended or adjusted under 35 U.S.C. 154(b) by 293 days.

(21) Appl. No.: 14/133,269

(22) Filed: Dec. 18, 2013

(65) Prior Publication Data

US 2015/0164206 A1 Jun. 18, 2015

(51) Int. Cl.

| | |
|---|---|
| ***A45F 5/02*** | (2006.01) |
| ***A44B 99/00*** | (2010.01) |
| ***A45F 5/06*** | (2006.01) |
| *A41D 19/00* | (2006.01) |

(52) U.S. Cl.

CPC ..... *A45F 5/021* (2013.01); *A44B 99/00* (2013.01); *A45F 5/06* (2013.01); *A41D 19/0041* (2013.01); *Y10T 24/1391* (2015.01); *Y10T 24/1394* (2015.01); *Y10T 24/44376* (2015.01); *Y10T 29/4984* (2015.01)

(58) Field of Classification Search

CPC ... A45F 5/021; A44B 99/00; Y10T 24/44376; Y10T 24/1394; Y10T 29/4984; Y10T 24/1391; A41D 19/0041

See application file for complete search history.

(56) References Cited

U.S. PATENT DOCUMENTS

| | | | | |
|---|---|---|---|---|
| 2,506,783 | A * | 5/1950 | Fauteux, Jr. | D06F 55/00 24/334 |
| 3,135,034 | A * | 6/1964 | Fauteux | D06F 55/00 24/327 |
| 4,277,864 | A * | 7/1981 | Orson, Sr. | A44B 99/00 24/327 |
| 5,655,270 | A | 8/1997 | Boisvert | |
| 5,687,458 | A | 11/1997 | Coker | |
| D399,650 | S | 10/1998 | Lee | |
| 6,010,044 | A | 1/2000 | Hsiao | |
| D432,910 | S | 10/2000 | Caper | |
| 6,212,688 | B1 | 4/2001 | Leslie | |
| 6,256,840 | B1 | 7/2001 | Elliott | |
| D478,723 | S | 8/2003 | Blanton | |
| 6,631,538 | B1 | 10/2003 | Carr | |
| 6,688,505 | B1 | 2/2004 | Bradley et al. | |
| 6,694,575 | B1 | 2/2004 | Martin | |
| 6,834,784 | B1 | 12/2004 | Webber et al. | |
| D523,330 | S | 6/2006 | Mattesky | |
| 7,213,307 | B2 | 5/2007 | Votel | |
| D631,254 | S | 1/2011 | Leslie | |

* cited by examiner

*Primary Examiner* — Robert J Sandy

(74) *Attorney, Agent, or Firm* — Stoel Rives LLP

(57) ABSTRACT

The present disclosure provides systems and methods for a fastening device for selectively securing an accessory, such as gloves. The fastening device may include an upper clamping member, a lower clamping member, and a biasing member manufactured as a single integral component. The upper clamping member may pivot with respect to the lower clamping member about a pin passing through pivot apertures formed in the clamping members. The biasing member may maintain the accessory clamping formed by the clamping members in a closed, clamped position. The accessory clamp may be configured to selectively secure any of a wide variety of accessories. In various embodiments, the fastening device may include an integral belt clip for selectively securing the fastening device, and a clamped accessory, to a belt or other clippable item, such pants or a jacket.

13 Claims, 7 Drawing Sheets

ACCESSORY FASTENING DEVICE

TECHNICAL FIELD

This disclosure relates to mechanical fastening devices. For example, this disclosure relates to clip devices for securing personal accessories, such as gloves, to the belt or other article of clothing of a user.

BRIEF DESCRIPTION OF THE DRAWINGS

Non-limiting and non-exhaustive embodiments of the disclosure are described herein, including various embodiments of the disclosure with reference to the figures described below.

Figure 1A:
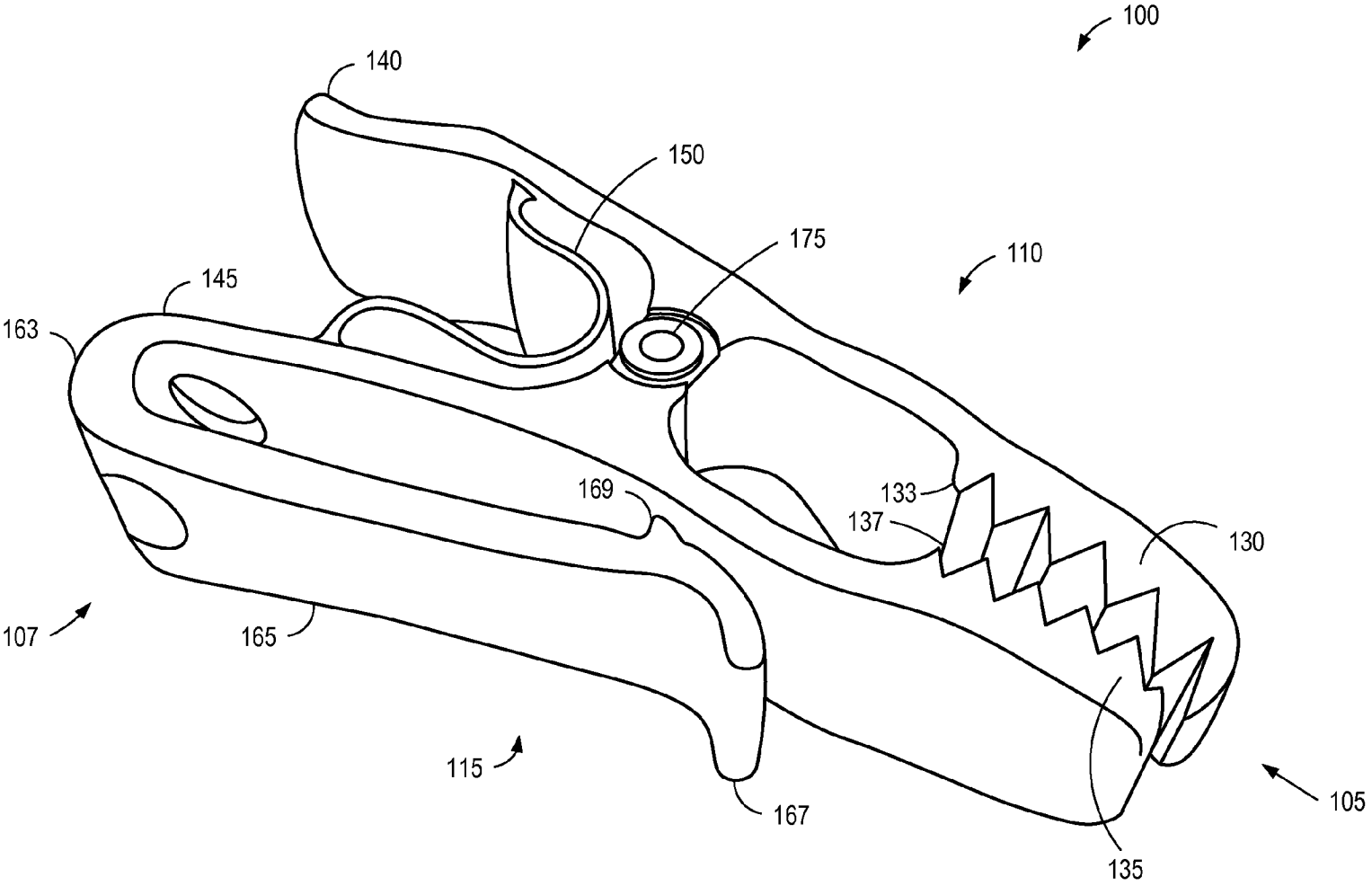
FIG. 1A illustrates a lower perspective view of one embodiment of a fastening device, including an accessory clamp and a belt clip.

References to the figures throughout the description are for convenience only. As provided herein, embodiments of the systems and methods described herein may include one or more additional components or features not illustrated in the figures. Similarly, one or more of the illustrated components or features may be omitted and/or substituted for a different component or feature in any of the embodiments described herein. Furthermore, the described features, structures, or characteristics may be combined in any suitable manner in one or more alternative embodiments.

DETAILED DESCRIPTION

According to various embodiments described herein, a fastening device is provided for selectively securing an accessory, such as gloves, hats, wires, tools, keys, etc. In various embodiments, the fastening device includes an integrated belt clip for securing the fastening device to the belt or pants of a user, or to any other clippable object.

In various embodiments, the fastening device may include an upper clamping member and a lower clamping member configured to pivotally interact to secure an accessory. For instance, the upper clamping member may include a first end with an inner clamping surface and a second end with a user-engageable outer surface. Similarly, the lower clamping member may include a first end with an inner clamping surface and a second end with a user-engageable outer surface. In some embodiments, the user-engageable outer surface of the lower clamping member may comprise a portion of a clip member of an integral belt clip.

Each of the clamping members may also include a pivot aperture through which a pin may be passed to form a pivot point of the clamping members. The pivot apertures may be holes formed in a protrusion between the first and second ends of each of the clamping members. Alternatively, the pivot apertures may be apertures only in the sense that they are configured to receive a pin. For instance, the pivot apertures may each comprises C-shaped clips configured to snap around a pin and thereby secure the pin within the center region of the C-shaped clips.

In various embodiments, the pivot apertures may be formed in the main body of one or both of the clamping members. Each of the clamping members may be substantially straight between the first end and the second end. Alternatively, each of the clamping members may be continuously curved or include curved portions. For instance, the user-engageable outer surface of the upper clamping member may be curved, widened, and/or include frictional features to facilitate the engagement of an operator's hand, finger, or thumb.

In some embodiments, the user-engageable outer surface of the upper clamping member may include a patch of frictional and/or padded material to facilitate user engagement. Similarly, the user-engageable outer surface of the upper clamping member may include one or more logos, markings, or other identifying or informational material that may or may not simultaneously serve a frictional or padding purpose.

In some embodiments, a logo, marking, or other informational material may be displayed on another portion of the fastening device. For example, the outer surface of the first end of the upper clamping member (the opposite surface from the clamping surface) may be widened and/or rounded and accommodate a logo or other informational material.

The upper clamping member and the lower clamping member may or may not be curved and/or shaped the same. In some embodiments, the inner clamping surface of the upper clamping member may have a larger area and/or be wider than the inner clamping surface of the lower clamping member.

Moreover, the user-engageable surface of the upper clamping member may be substantially different from the user-engageable surface of the lower clamping member. For example, the user-engageable surface of the upper clamping member may be configured for engagement by a thumb or single finger, while the user-engageable surface of the lower clamping member may be configured for engagement by multiple fingers and/or a palm of a hand. In other embodiments, the user-engageable surfaces of the clamping members may be adapted for engagement by any portion of a user's hand or even other portions of a user's body.

The clamping surfaces of one or both of the clamping members may include frictional features adapted to secure one or more types of accessories. The illustrated embodiments show ridges or teeth for securing accessories. In alternative embodiments, the clamping surfaces may include integral frictional features, protrusions, intrusions, wavy ridges, straight ridges, or other shaped features. In some embodiments, the clamping surfaces may be fitted with a non-integral frictional feature, such as an adhered rubber boot or rubber pad.

In various embodiments, the lower clamping member may include an integral or non-integral clip member configured to form a belt clip in conjunction with an outer surface of the lower clamping member. In some embodiments, the clip member may be integrally formed with the lower clamping member. In other embodiments, the clip member may be a separate component (i.e., non-integral) that is fastened or otherwise secured to the lower clamping member. The clip member may be resiliently secured to or resiliently integral with the lower clamping member, so as to form a resilient belt clip. Alternatively, the clip member may include a biasing member, such as a spring or other resilient member, to provide a resistive force for the belt clip.

The clip member may include a protrusion, hook, or other feature extending between the inner surface of the clip member and the outer surface of the lower clamping member. For example, an inverted protrusion or hook may be configured to maintain a belt within a gap between the inner surface of the clip member and the outer surface of the lower clamping member.

A biasing member may provide a biasing force to maintain the inner clamping surfaces of the clamping members in a clamped or joined position. The biasing member may be on the opposite side of the pivot apertures relative to the clamping surfaces of the clamping member. Accordingly, the biasing member may exert a force to separate the user-engageable outer surfaces of the clamping members. In some embodiments, the biasing member may be on the same side of the pivot apertures as the clamping surfaces, in which case the biasing member may exert a force to pull the clamping surfaces together. In some embodiments, the biasing member may comprise multiple biasing elements.

According to various embodiments, the biasing member may be integrally formed with and connected to the upper clamping member and the lower clamping member. That is, the manufacturing of the fastening device may include the formation of an integral, single component that includes the upper clamping member, the lower clamping member, and the biasing member. Moreover, in some embodiments, the integral, single component may further include the clip member. Thus, in some embodiments, the fastening device as described herein may be manufactured as a single integral component, with the exception of the pin, which may be subsequently inserted into the integral pivot apertures formed on the upper and lower clamping members.

In some embodiments, an aperture may be formed in one or more of the upper clamping member, the lower clamping member, and the clip member. For example, in one embodiment the clip member is formed as an integral component with the lower clamping member and substantially concentric apertures are formed in both the clip member and the lower clamping member. The substantially concentric apertures may be formed near the second end (i.e., near the user-engageable surface) of the lower clamping member.

The embodiments of the disclosure will be best understood by reference to the drawings, wherein like parts are designated by like numerals throughout. The components of the disclosed embodiments, as generally described and illustrated in the figures herein, could be arranged and designed in a wide variety of different configurations. Furthermore, the features, structures, and operations associated with one embodiment may be applicable to or combined with the features, structures, or operations described in conjunction with another embodiment. In other instances, well-known structures, materials, or operations are not shown or described in detail to avoid obscuring aspects of this disclosure.

Reference throughout this specification to "one embodiment" or "an embodiment" means that a particular feature, structure, or characteristic described in connection with the embodiment is included in at least one possible implementation. Thus, the appearance of the phrases "in various embodiments" and "in some embodiments" throughout this specification are not necessarily all referring to the same embodiment. However, all possible combinations and permutations of each of the described embodiments are contemplated as possible embodiments.

The phrases "connected to" and "integral with" and other related terms refer to any form of interaction between two or more components, including mechanical, electrical, magnetic, and electromagnetic interaction. Two components may be connected to each other, even though they are not in direct contact with each other, and even though there may be intermediary devices between the two components.

Various manufacturing techniques, materials, and combinations thereof may be used to create and/or enhance the fastening devices described herein. As will be appreciated by one of skill in the art, the described fastening devices, or at least portions thereof, may be manufactured using various metals, plastics, rubbers, etc. For example, one or more of the following materials may be utilized: polyethylene terephthalate, polystyrene, polyvinyl chloride, polytetrafluoroethylene, polyvinylidine chloride, polyethylene (LDPE and HDPE), polypropylene, and/or other types of plastics and rubbers. Various manufacturing processes may be utilized as well, including, but not limited to, extrusion, injection molding, blow molding, rotational molding, three-dimensional printing, casting, etching, molding, joining, evaporative-pattern casting, spray forming, dip molding, thermoforming, and/or other processes.

Thus, the following detailed description of the embodiments of the systems and methods of the disclosure is not intended to limit the scope of the disclosure, as claimed, but is merely representative of possible embodiments. In addition, the steps of a method do not necessarily need to be executed in any specific order, or even sequentially, nor do the steps need to be executed only once.

FIG. 1A illustrates a lower perspective view of one embodiment of a fastening device 100, including an accessory clamp 105 and a belt clip 107. The illustrated fastening device 100 includes an upper clamping member 110 and a lower clamping member 115. The upper clamping member 110 may include an inner clamping surface 130 with frictional features 133 disposed thereon. The opposite end of upper clamping member 110 may include a user-engageable outer surface 140.

The upper clamping member 110 may be configured to pivot with respect to the lower clamping member 115 about pin 175 passing through pivot apertures in the upper 110 and lower 115 clamping members. The upper clamping member 110 may pivot with respect to the lower clamping member 115 between a closed position (as illustrated) in which the accessory clamp 105 (comprising the inner clamping surfaces 130 and 135 of the upper 110 and lower 115 clamping members) is in a clamped position and an open position in which the accessory clamp 105 is in an unclamped position (as described in conjunction with FIG. 3 below).

Similarly, the illustrated lower clamping member 115 includes an inner clamping surface 135 with frictional features 137 disposed thereon. The opposite end of the lower clamping member 115 may include a user-engageable outer surface 145. In some embodiments, the user-engageable outer surface 145 may include or be embodied as a clip member 165 resiliently connected, at connection 163, to the lower clamping member 115. That is, the user-engageable outer surface 145 may comprise the clip member 165.

In various embodiments, the clip member 165 may be configured to form a belt clip in combination with at least a portion of the outer surface of the lower clamping member 115. The clip member 165 may resiliently flex about the connection 163 to frictionally retain a belt, pants, or other clippable object. In various embodiments, the clip member 165 may include a curved portion 167 to provide a user-accessible portion for flexing the clip member 165. The clip member 165 may also include an inverted hook 169 on an inner surface of the clip member 165.

The fastening device 100 may also include an integral biasing member 150 configured to bias the upper clamping member 110 and the lower clamping member 115 such that the accessory clamp 105 is biased in a clamped position. In various embodiments, the biasing member 150 may be integrally formed with and connected to the upper clamping member 110 and the lower clamping member 115. That is, the upper clamping member 110, the lower clamping member 115, the biasing member 150, and optionally the clip member 165 may be manufactured as a single integral component. The biasing member 150 may be U-shaped as illustrated. Alternatively, the biasing member may be any of a wide variety of biasing shapes and/or include a plurality of biasing elements.

The accessory clamp of the fastening device 100 may be capable and/or specifically configured for securing one or more of gloves, ear protection, respirators, hard hats, rigging, keys, masks, helmets, hats, rags, cleaning clothes, towels, sports equipment, industrial equipment, tools, wire, and/or other items. The exact shape, size, dimensions, and/or other characteristics of the upper clamping member 110, the lower clamping member 115, the biasing ember 150, and/or other features/components of the fastening device may vary from the illustrated embodiments and/or be configured for a particular purpose.

Figure 1B:
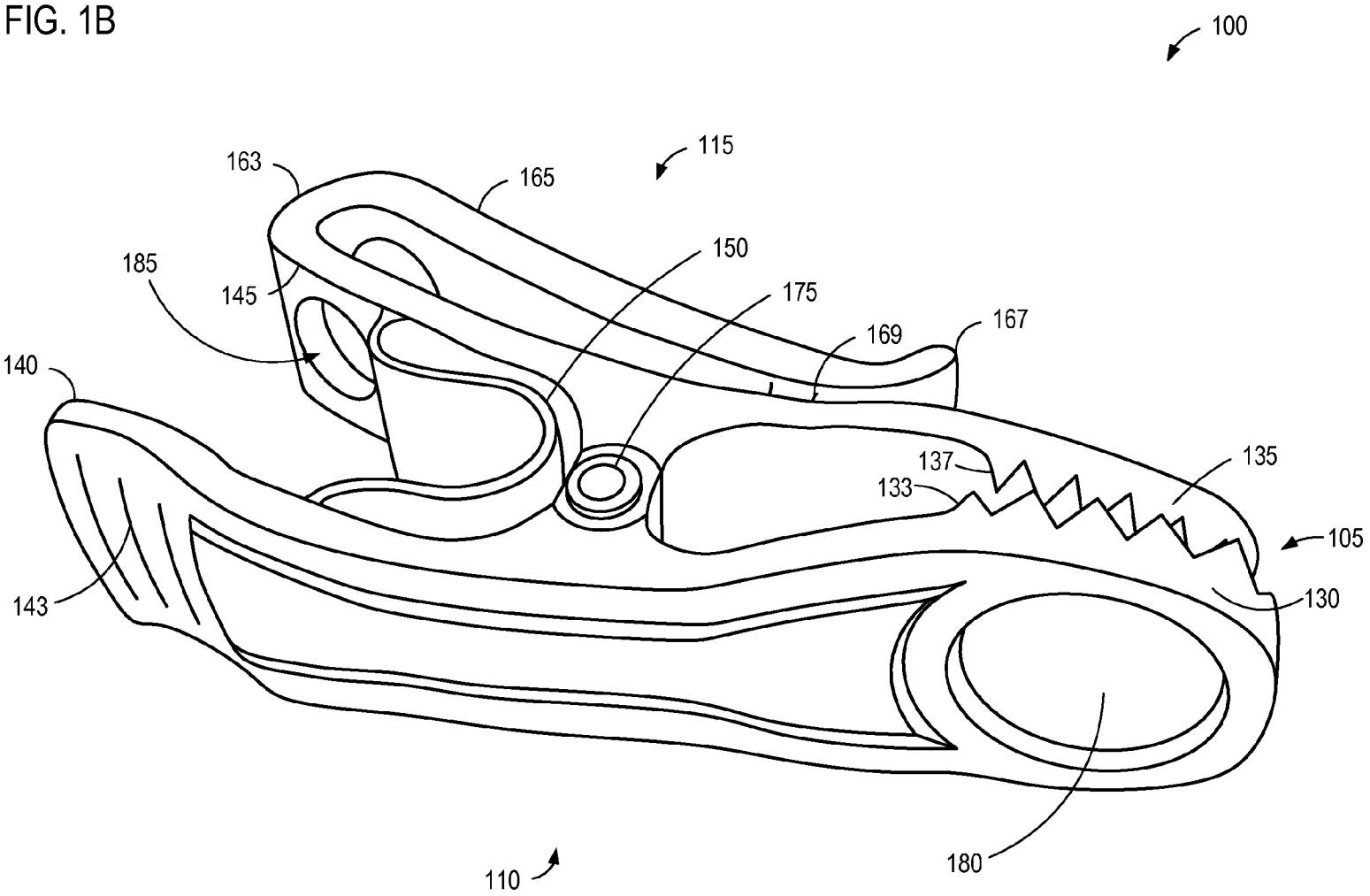
FIG. 1B illustrates an upper perspective view of the fastening device illustrated in FIG. 1A.

FIG. 1B illustrates an upper perspective view of the fastening device 100. As illustrated, the upper clamping member 110 includes various stylistic and functional features, such as frictional features 143 on the user-engageable outer surface 140. The opposite end of the upper clamping member 110 may include a circular or other shaped intrusion 180. Alternatively, the intrusion 180 may be a protrusion or just a flat, conspicuous feature. The intrusion 180 may include or receive a logo or other informational material.

FIG. 1B also illustrates concentric pivot apertures 185 formed through the lower clamping member 115 and the clip member 165. The pivot apertures 185 may be configured and/or sized to receive a key ring and/or a carabineer.

Figure 2A:
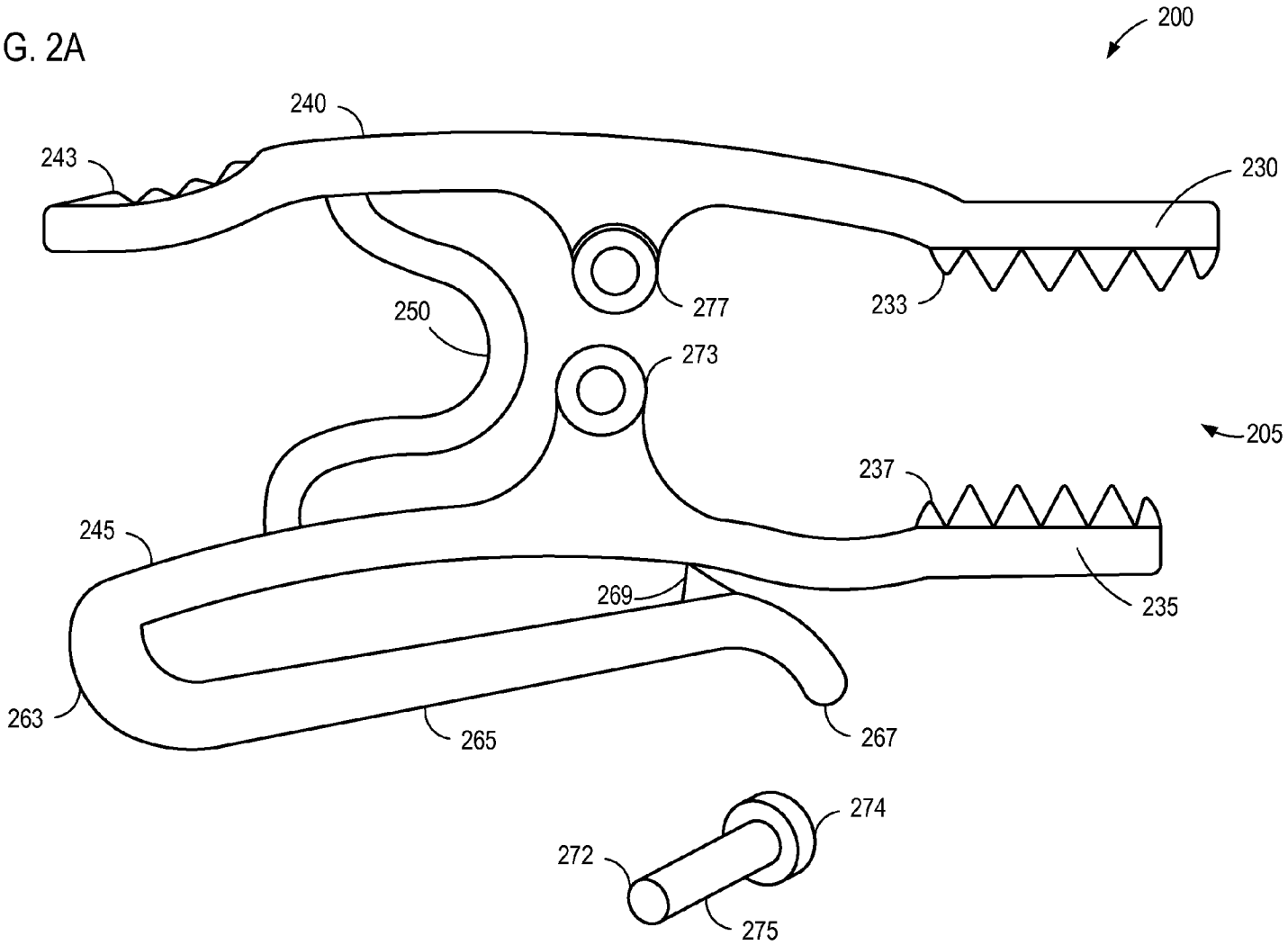
FIG. 2A illustrates a side view of one embodiment of a fastening device, including a single-component accessory clamp and biasing member.

FIG. 2A illustrates a side view of one embodiment of a fastening device 200, including a single-component accessory clamp 205 and a biasing member 250. As illustrated, the fastening device 200 may include an upper clamping member 240, a lower clamping member 245, the biasing member 250, and a clip member 265 formed as a single integral component. For example, the upper clamping member 240, the lower clamping member 245, the biasing member 250, and the clip member 265 may be injection molded as a unified component. Thus, as illustrated, the biasing member 250 may permanently join the upper clamping member 240 and the lower clamping member 245.

As illustrated, the upper clamping member 240 may include a pivot aperture 277. The pivot aperture 277 may be configured to receive a pin. The pivot aperture 277 may be formed as a C-shaped clip configured to secure a pin, rather than as a true aperture. The upper clamping member 240 may also include a user-engageable outer surface 243 with one or more frictional features. The opposite end of the upper clamping member 240 may include an inner clamping surface 230 with one or more frictional features 233.

The lower clamping member 245 may include a pivot aperture 273. Again, the pivot aperture 273 may be formed as a C-shaped clip configured to secure a pin, rather than as a true aperture. The lower clamping member 245 may also include a user-engageable outer surface (optionally comprising a clip member 265). The opposite end of the lower clamping member 245 may include an inner clamping surface 235 with one or more frictional features 237.

The clip member 265 may be configured to form a belt clip in combination with at least a portion of the outer surface of the lower clamping member 245. The clip member 265 may resiliently flex about a connection 263 to frictionally retain a belt, pants, or other clippable object. In various embodiments, the clip member 265 may include a curved portion 267 to provide a user-accessible portion for flexing the clip member 265. The clip member 265 may also include an inverted hook 269 on an inner surface of the clip member 265.

A pin 275 may be inserted into the pivot apertures 277 and 273 when they are aligned, such that the clamping surfaces 230 and 235 are biased by the biasing member 250 in a clamped, or closed, position. The pin 275 may include an end-cap 274 to prevent the pin 275 from passing through the pivot apertures 273 and 277. The other end 272 of the pin 275 may be deformed after passing through the pivot apertures 273 and 277 to prevent the removal of the pin 275.

Figure 2B:
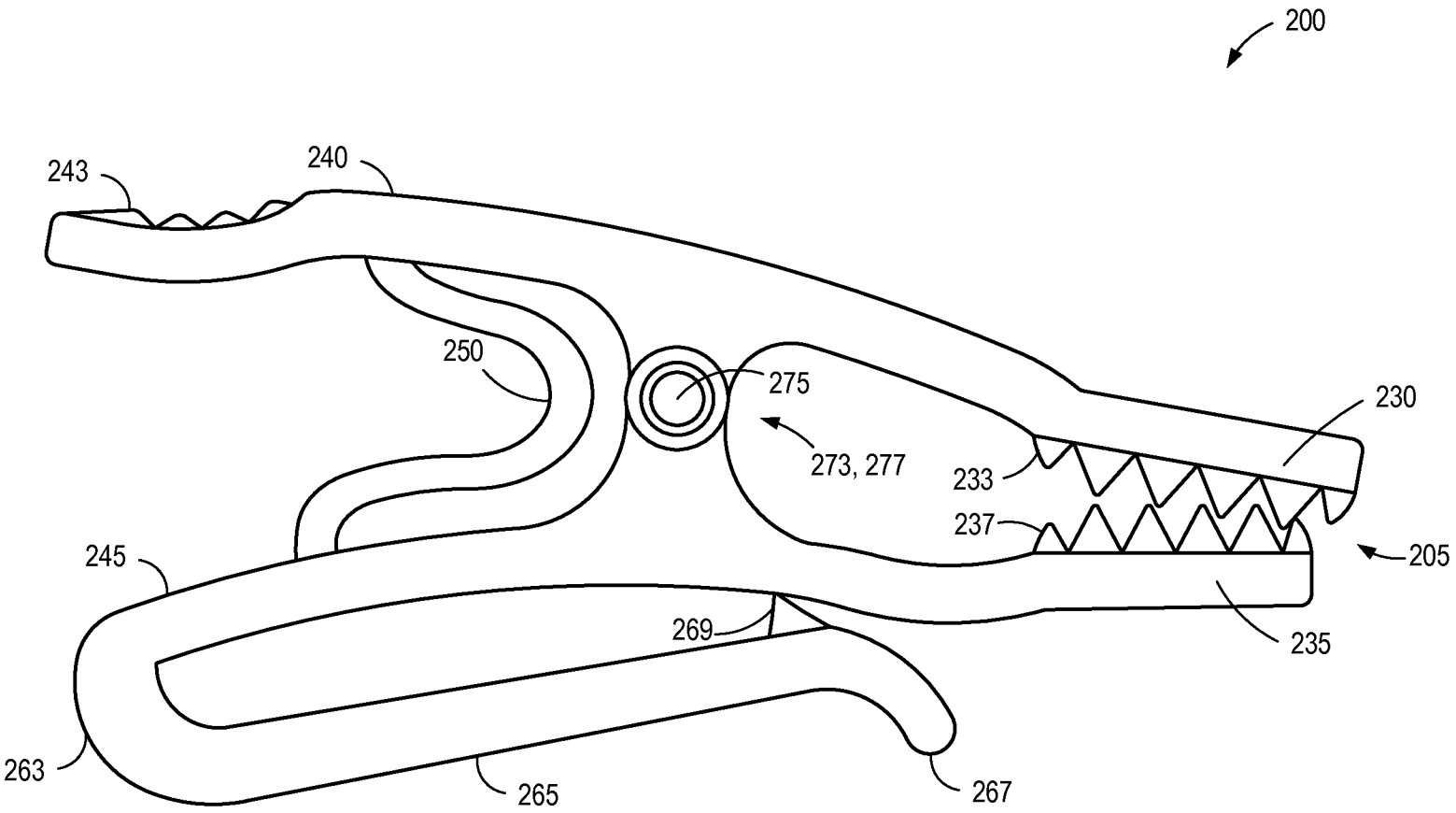
FIG. 2B illustrates a pin inserted into the pivot apertures of the clamping members of the fastening device shown in FIG. 2A.

FIG. 2B illustrates the pin 275 inserted into the pivot apertures 273 and 277 of the clamping members 240 and 245 of the fastening device 200 shown in FIG. 2A. With the pin 275 inserted, the biasing member 250 biases the clamping members 240 and 245, causing the clamping surfaces 230 and 235 to engage one another.

Figure 2C:
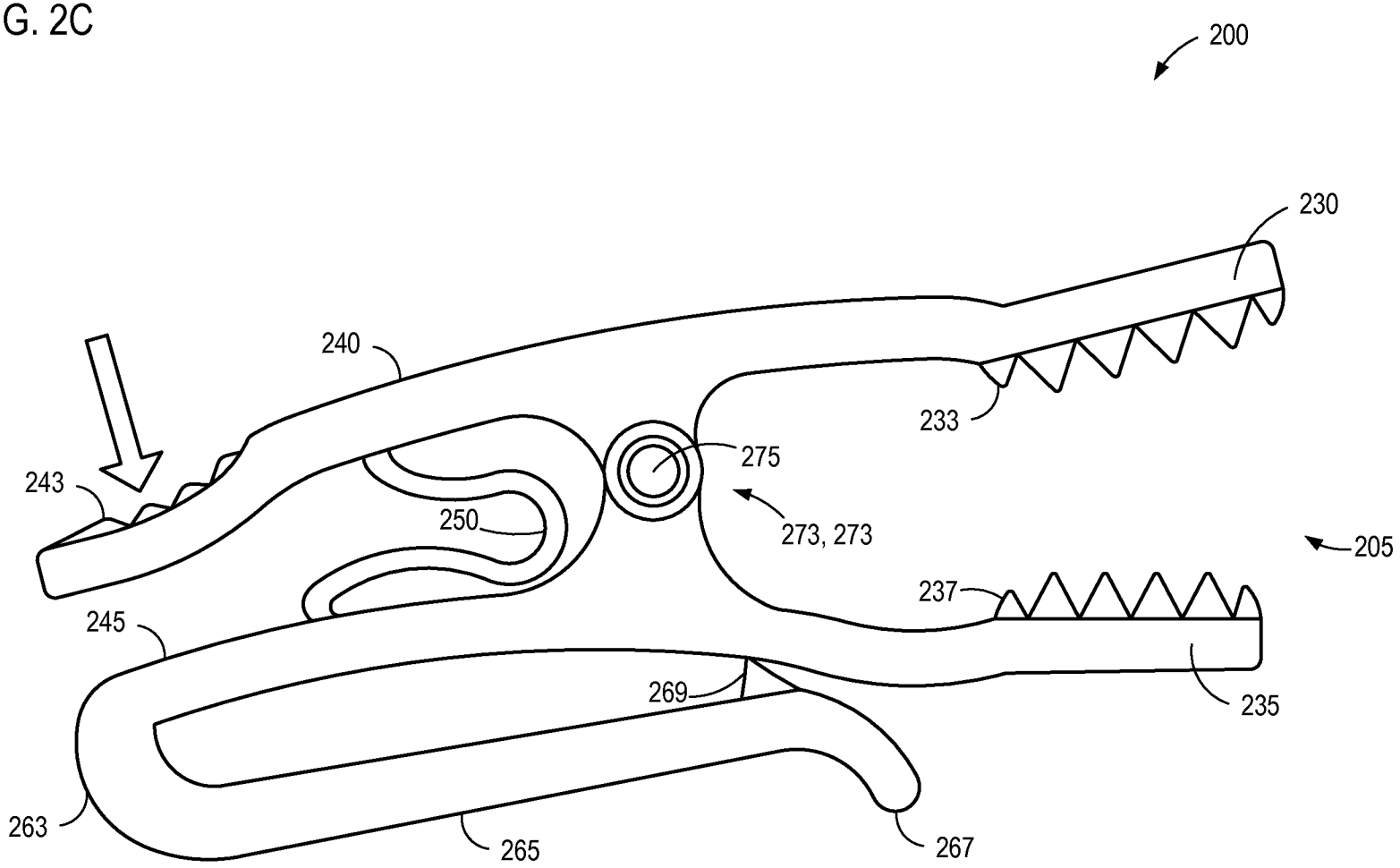
FIG. 2C illustrates the upper clamping member pivoting about the apertures and the pin to open the clamping members, according to one embodiment.

As illustrated in FIG. 2C, the upper clamping member 240 pivots about the pivot apertures 273 and 277 and the pin 275 to open the clamping surfaces 230 and 235 of the clamping members 240 and 245. The relative pivoting of the upper clamping member 240 and the lower clamping member 245 allows a user to selectively open and close the accessory clamp 205. The frictional features on the user-engageable outer surface 243 of the upper clamping member 240 may facilitate the relative pivoting of the clamping members 240 and 245.

Figure 3A:
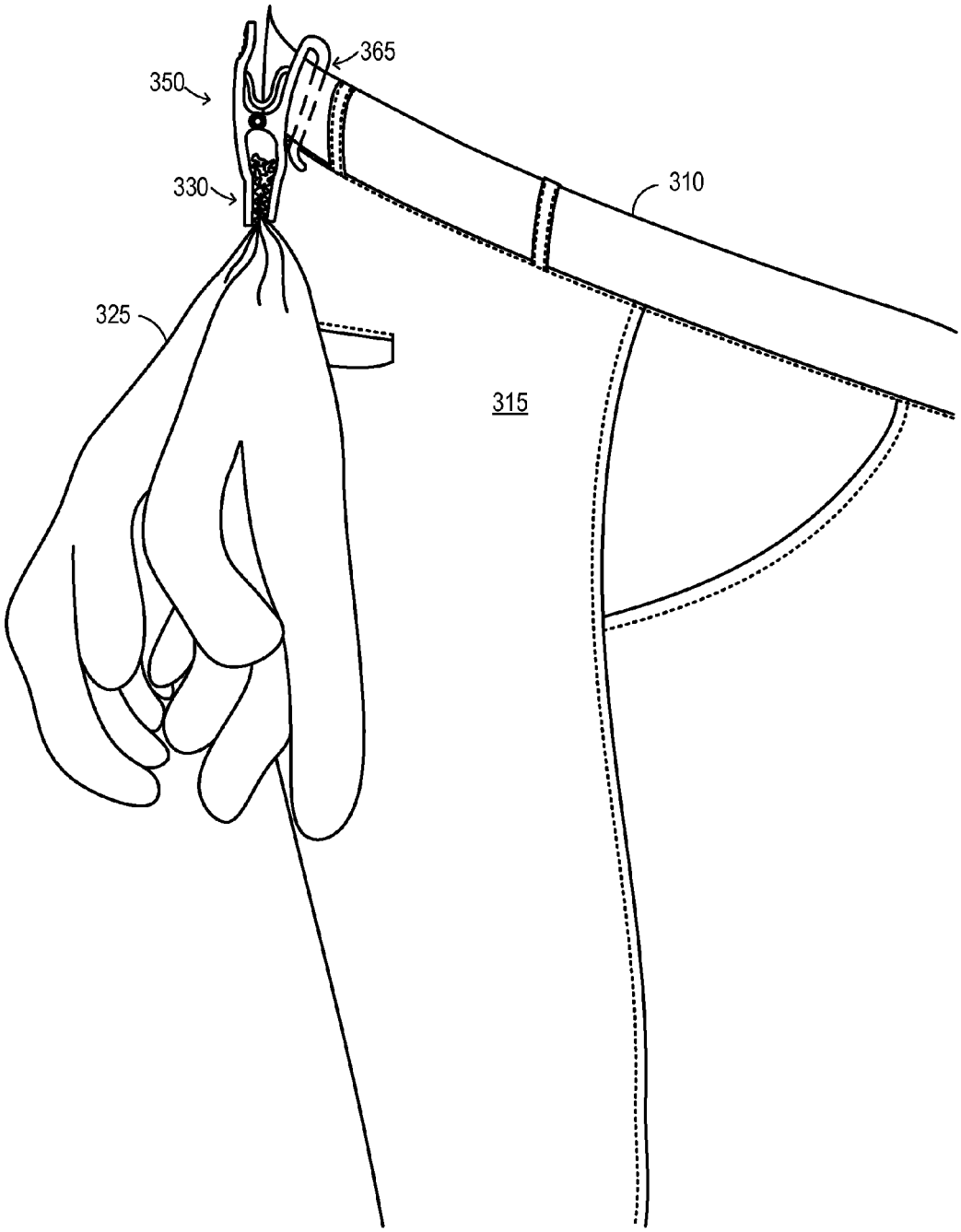
FIG. 3A illustrates one embodiment of a fastening device clipped to a belt of a user and securing a pair of gloves between the clamping surfaces of the clamping members.

FIG. 3A illustrates one embodiment of a fastening device 350 clipped to a belt 310 of a user's pants 315 via a belt clip 365 of the fastening device 350. The accessory clamp 330 of the fastening device 350 may frictionally secure a pair of gloves 325. The accessory clamp 330 may be configured according to any of the variously described embodiments herein. According to various embodiments, the accessory clamp 330 comprises the inner clamping surfaces of upper and lower clamping members. As described according to various embodiments, the upper clamping member, the lower clamping member, the biasing member, and the belt clip 365 may be manufactured as a single integral component. A pin may be inserted into pivot apertures associated with each of the clamping members, as described herein.

Figure 3B:
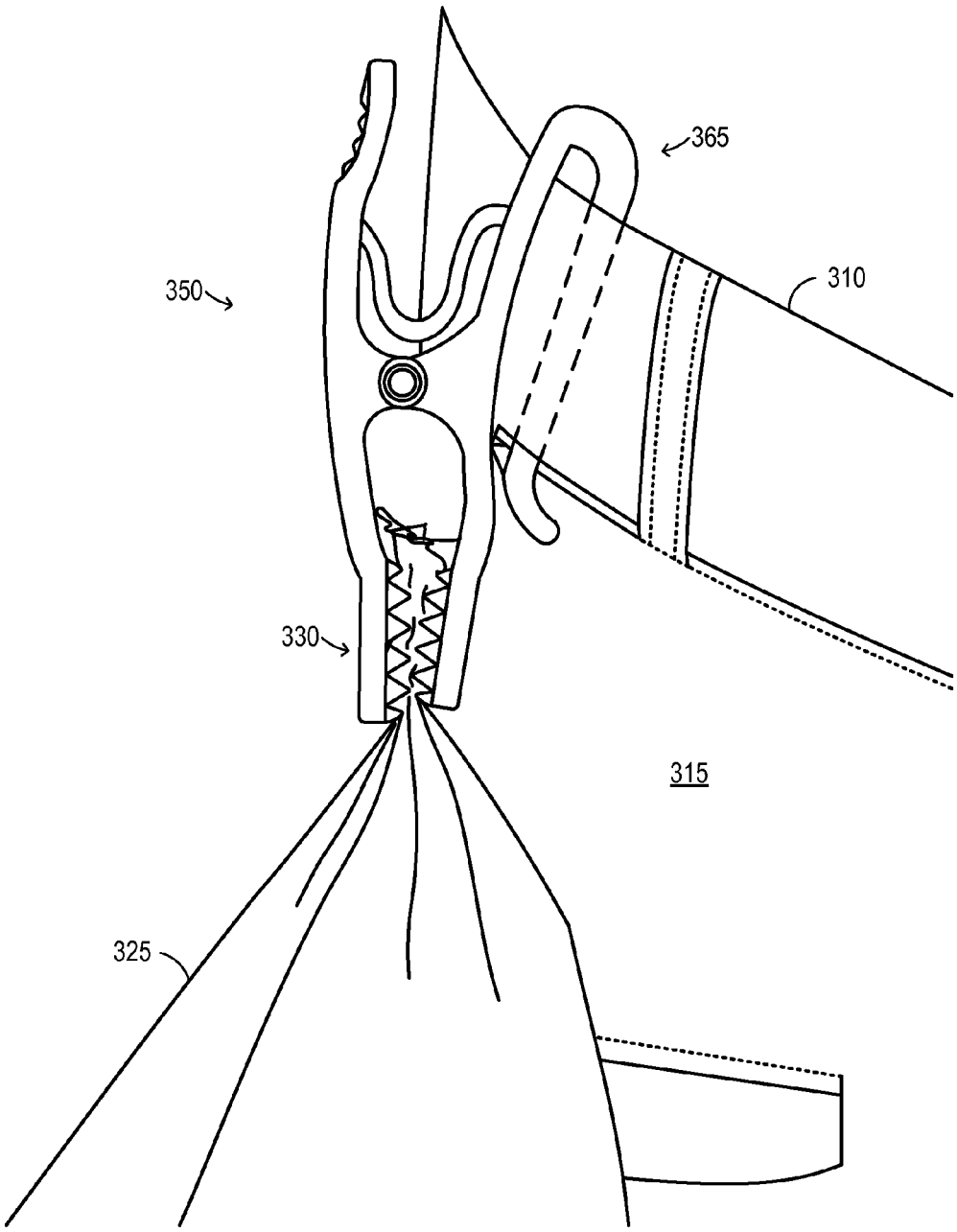
FIG. 3B illustrates a close-up view of the embodiment of the fastening device illustrated in FIG. 3A.

FIG. 3B illustrates a close-up view of the embodiment of the fastening device 350 illustrated in FIG. 3A. The close-up view more clearly illustrates the accessory clamp 330 securing a pair of gloves 325. As previously described, the accessory clamp 330 may be used to secure any number of accessories, including gloves, hats, clothing articles, keys, and/or other accessories. The belt clip 365 of the fastening device 350 may be used to selectively maintain the fastening device 350 secured to a belt 310, clothing article (such as pants 315, coats, shirts, etc.), and/or other clippable item.

As previously described, the fastening device 350 may be manufactured by forming as a single integral component an upper clamping member, a lower clamping member, a biasing member, and optionally a clip member. A pin may be formed to be inserted within aligned pivot apertures of the clamping members. Once the pin has been inserted within the pivot apertures, the biasing member may be configured to bias the clamping surfaces of the clamping members in a clamped position.

This disclosure has been made with reference to various exemplary embodiments, including the best mode. However, those skilled in the art will recognize that changes and modifications may be made to the exemplary embodiments without departing from the scope of the present disclosure. While the principles of this disclosure have been shown in various embodiments, many modifications of structure, arrangements, proportions, elements, materials, and components may be adapted for a specific environment and/or operating requirements without departing from the principles and scope of this disclosure. These and other changes or modifications are intended to be included within the scope of the present disclosure.

This disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, a required, or an essential feature or element. The scope of the present invention should, therefore, be determined by the following claims.

What is claimed is:

1. A fastening device for releasably securing accessories, comprising:

an upper clamping member comprising, a first end including an inner clamping surface, a second end including a user-engageable outer surface, and a pivot aperture positioned between the first end and the second end;

a lower clamping member comprising, a first end including an inner clamping surface, a second end including a user-engageable outer surface, and a pivot aperture positioned between the first end and the second end;

a pin configured to be inserted into the pivot apertures of the upper clamping member and the lower clamping member, such that the clamping surfaces of the upper clamping member and the lower clamping member are configured to selectively engage one another by pivoting about the pin via the pivot apertures;

a clip member connected to the lower clamping member to form a belt clip in combination with at least a portion of the outer surface of the lower clamping member;

an aperture extending through the clip member and the lower clamping member; and a biasing member integrally joining the upper clamping member and the lower clamping member between the pivot apertures of the upper and lower clamping members and the second ends of the upper and lower clamping members, wherein the biasing member is configured to bias the clamping surfaces of the upper and lower clamping members in a clamped position.

2. The fastening device of claim 1, wherein the upper clamping member, the lower clamping member, the biasing member, and the clip member are manufactured as a single integral component.

3. The fastening device of claim 1, wherein each of the clamping surfaces of the upper and lower clamping members comprises a plurality of ridges.

4. The fastening device of claim 1, wherein the biasing member comprises a U-shaped biasing member.

5. A method of manufacturing a fastening device for releasably securing accessories, comprising:

forming as a single integral component an upper clamping member, a lower clamping member, a clip member, and a biasing member, wherein the upper clamping member comprises, a first end having an inner clamping surface, a second end having an outer user-engageable surface, and a pivot aperture positioned between the first and second ends;

the lower clamping member comprises, a first end having an inner clamping surface, a second end having an outer user-engageable surface, and a pivot aperture positioned between the first and second ends;

the biasing member integrally joins the upper clamping member and the lower clamping member between the pivot apertures of the upper and lower clamping members and the second ends of the upper and lower clamping members; and the clip member forming a belt clip in combination with at least a portion of the lower clamping member, and wherein an aperture is formed through the clip member and the lower clamping member; and forming a pin configured to be inserted into the pivot apertures of the upper clamping member and the lower clamping member in an aligned position, such that the clamping surfaces of the upper clamping member and the lower clamping member are configured to selectively engage one another by pivoting about the pin via the pivot apertures, and wherein the biasing member is configured to bias the clamping surfaces of the upper and lower clamping members in a clamped position.

6. The method of claim 5, wherein the clip member comprises an inverted hook on an inner surface configured to maintain a belt within a gap between the inner surface of the clip member and the outer surface of the lower clamping member.

7. The method of claim 5, further comprising forming a plurality of ridges on each of the clamping surfaces of the upper and lower clamping members.

8. The method of claim 5, wherein the biasing member comprises a U-shaped biasing member.

9. A fastening device for releasably securing accessories, comprising:

a first means for clamping comprising, a first end including an inner clamping surface, a second end including a user-engageable outer surface, and a pivot means for receiving a pin positioned between the first end and the second end;

a second means for clamping comprising, a first end including an inner clamping surface, a second end including a user-engageable outer surface, and a pivot means for receiving a pin positioned between the first end and the second end;

a clipping means connected to the second means for clamping to form a belt clip in combination with at least a portion of the second means for clamping;

an aperture extending through the clipping means and the second means for clamping;

a pin configured to be inserted into the pivot means of the first and second means for clamping, such that the clamping surfaces of the first and second means for clamping are configured to selectively engage one another by pivoting about the pin; and a means for biasing integrally joining the first and second means for clamping, wherein the means for biasing is positioned between the pivot means of the first and second means for clamping and the second ends of the first and second means for clamping, and wherein the means for biasing is configured to bias the clamping surfaces of the first and second means for clamping in a clamped position.

10. The fastening device of claim 9, wherein the first means for clamping, the second means for clamping, the means for biasing, and the clipping means are manufactured as a single integral component.

11. The fastening device of claim 9, wherein the aperture is positioned proximate the second end of the second means for clamping.

12. The fastening device of claim 9, wherein each of the clamping surfaces of the first and second means for clamping comprises a plurality of ridges.

13. The fastening device of claim 9, wherein the means for biasing comprises a U-shaped biasing member.

* * * * *